US006955523B2

(12) United States Patent
McClelland

(10) Patent No.: US 6,955,523 B2
(45) Date of Patent: Oct. 18, 2005

(54) COOLING SYSTEM FOR A TURBINE VANE

(75) Inventor: Robert J. McClelland, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 96 days.

(21) Appl. No.: 10/637,478

(22) Filed: Aug. 8, 2003

(65) Prior Publication Data

US 2005/0031445 A1 Feb. 10, 2005

(51) Int. Cl.[7] ..... F01D 9/02
(52) U.S. Cl. ..... 415/115
(58) Field of Search ..... 415/115, 159, 415/191; 416/95, 96 R, 97 R

(56) References Cited

U.S. PATENT DOCUMENTS

| | | | | |
|---|---|---|---|---|
| 3,369,792 A | * | 2/1968 | Kraimer et al. | 415/115 |
| 3,799,696 A | * | 3/1974 | Redman | 416/97 R |
| 4,604,031 A | | 8/1986 | Moss et al. | |
| 4,753,575 A | | 6/1988 | Levengood et al. | |
| 4,946,346 A | | 8/1990 | Ito | |
| 5,387,085 A | | 2/1995 | Thomas, Jr, et al. | |
| 5,394,687 A | | 3/1995 | Chen et al. | |
| 5,403,157 A | * | 4/1995 | Moore | 416/96 R |
| 5,511,309 A | | 4/1996 | Beabout | |
| 5,538,393 A | | 7/1996 | Thompson et al. | |
| 5,660,524 A | | 8/1997 | Lee et al. | |
| 5,902,093 A | | 5/1999 | Liotta et al. | |
| 6,036,436 A | | 3/2000 | Fukuno et al. | |
| 6,206,638 B1 | | 3/2001 | Glynn et al. | |
| 6,220,817 B1 | | 4/2001 | Durgin et al. | |
| 6,234,753 B1 | | 5/2001 | Lee | |
| 6,402,471 B1 | | 6/2002 | Demers et al. | |
| 6,474,947 B1 | | 11/2002 | Yuri | |
| 6,491,496 B2 | | 12/2002 | Starkweather | |

FOREIGN PATENT DOCUMENTS

WO WO 2003042503 A1 * 5/2003 ..... F01D/5/18

* cited by examiner

*Primary Examiner*—Edward K. Look
*Assistant Examiner*—Richard A. Edgar

(57) ABSTRACT

A turbine vane usable in a turbine engine and having at least one cooling system. The cooling system including an aft cooling circuit formed from at least one serpentine cooling path. The serpentine cooling path having at least one rib may include bypass orifices for allowing air to pass through the rib to shorten the distance of the serpentine cooling path through which at least some of the air passes. The bypass orifices allow a greater quantity of air to pass through the vane and be expelled into a disc to which the vane is movably coupled as compared to a similar shaped and sized serpentine cooling path not having the bypass orifices.

18 Claims, 3 Drawing Sheets

COOLING SYSTEM FOR A TURBINE VANE

FIELD OF THE INVENTION

This invention is directed generally to turbine vanes, and more particularly to hollow turbine vanes having cooling channels for passing fluids, such as air, to cool the vanes and supply air to the disc of a turbine assembly.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to a rotatable disc. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trialing edge, suction side, and pressure side of the vane. A substantially portion of the air is passed into a disc to which the vane is movable coupled. The air supplied to the disc may be used, among other uses, to cool turbine blade assemblies coupled to the disc.

As turbine engines have been made more efficient, increased demands have been placed on the cooling systems of turbine vanes and blades. Cooling systems have been required to supply more and more cooling air to various systems of a turbine engine to maintain the structural integrity of the engine and to prolong the turbine's life by removing excess heat. However, some cooling systems lack the capacity to deliver an adequate flow rate of cooling air to a turbine engine. In particular, turbine vanes often lack the ability to permit a sufficient amount of cooling air to flow through the vane and into the disc. Thus, a need exists for a turbine vane having a cooling system capable of dissipating heat from the vane and capable of passing a sufficient amount of cooling air through the vane and into the disc.

SUMMARY OF THE INVENTION

This invention relates to a turbine vane having a cooling system including at least a forward cooling circuit and an aft cooling circuit for allowing an increased amount of cooling fluid, such as, but not limited to, air, to pass through the vane to a disc while cooling the vane to a temperature within an acceptable range. The turbine vane may be formed from a generally elongated vane formed from at least one outer wall and having a leading edge, a trailing edge, a pressure side, and a suction side. In at least one embodiment, the aft cooling circuit may be formed from a serpentine cooling path. The serpentine cooling path may be formed, in part, from a first inflow section, a first outflow section, and a second inflow section. The first inflow section may extend from an opening at a first end of the turbine vane adapted to be coupled to a vane carrier and a first end at 100 percent span of the serpentine cooling path to a first turn at 0 percent span of the serpentine cooling path. In at least one embodiment, the first inflow section may be generally parallel with a longitudinal axis of the turbine vane.

The first outflow section may be in communication with the first inflow section and may extend from the first turn generally toward the first end of the serpentine cooling path where it is coupled to the second turn. The second inflow section may be in communication with the first outflow section through the second turn and may extend from the second turn to an opening in a second end of the turbine vane adapted to be movably coupled to a disc.

In at least one embodiment, the first inflow section and the first outflow section may be separated by at least one rib extending from the first end of the serpentine cooling path substantially to the second end of the serpentine cooling path. The at least one rib may include one or more bypass orifices creating a pathway between the first inflow section and the first outflow section. The bypass orifices may be positioned between about 15 percent span of the serpentine cooling path and about 85 percent span of the serpentine cooling path. The diameter of the bypass orifices may be equal or different sizes. In at least one embodiment, the diameter of the bypass orifices may be about 4 millimeters (mm).

In order to improve the fluid dynamics of the air flowing through the aft cooling circuit, the cross-sectional area of the first inflow section may be different at different locations in the aft cooling circuit. In particular, the cross-sectional area of the first inflow section may decrease moving from the 100 percent span of the serpentine cooling path toward the 0 percent span of the serpentine cooling path. Specifically, a cross-sectional area at the 100 percent span of the serpentine cooling path may be larger than a cross-sectional area at the 10 percent span of the serpentine cooling path. Further, the cross-sectional area at the 100 percent span of the serpentine cooling path may be larger than a cross-sectional area at the 50 percent span of the serpentine cooling path. For instance, the cross-sectional area of the first inflow section at the 50 percent span of the serpentine cooling path may be about 0.7 units, whereas a cross-sectional area at the 100 percent span of the serpentine cooling path may be about 1 unit. In addition, the cross-sectional area at the 50 percent span of the serpentine cooling path may be larger than a cross-sectional area at the 10 percent span of the serpentine cooling path. In at least one embodiment, the cross-sectional area of the first inflow section at 10 percent span of the serpentine cooling path may be about 0.4 units, whereas a cross-sectional area at the 100 percent span of the serpentine cooling path may be about 1 unit.

In operation, a cooling fluid, such as, but not limited to air, may pass through one or more orifices at 100 percent span of the vane into the forward and aft cooling circuits. At least some of the cooling fluid entering the forward cooling circuit flows through the vane and into a disc, and at least some of the cooling fluid flows exits the vane through a plurality of exhaust orifices in the leading edge and the suction and pressure sides of the vane. The air entering the aft cooling circuit flows through a serpentine cooling path and is exhausted into the disc or through a plurality of orifices in a trailing edge or in the suction or pressure sides of the vane. As the air flows through a first inflow section of the serpentine cooling path, air may pass through one or more bypass orifices in a rib separating the first inflow section and the first outflow section. By allowing air to pass through the rib, rather than having air flow through the entire length of the first inflow section, through the first turn, and through the entire length of the first outflow section, the amount of air capable of flowing through the serpentine cooling path is increased. The increased air flow through the serpentine cooling path and into the disc is advantageous in at least some turbine engines requiring greater amounts of cooling fluid. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
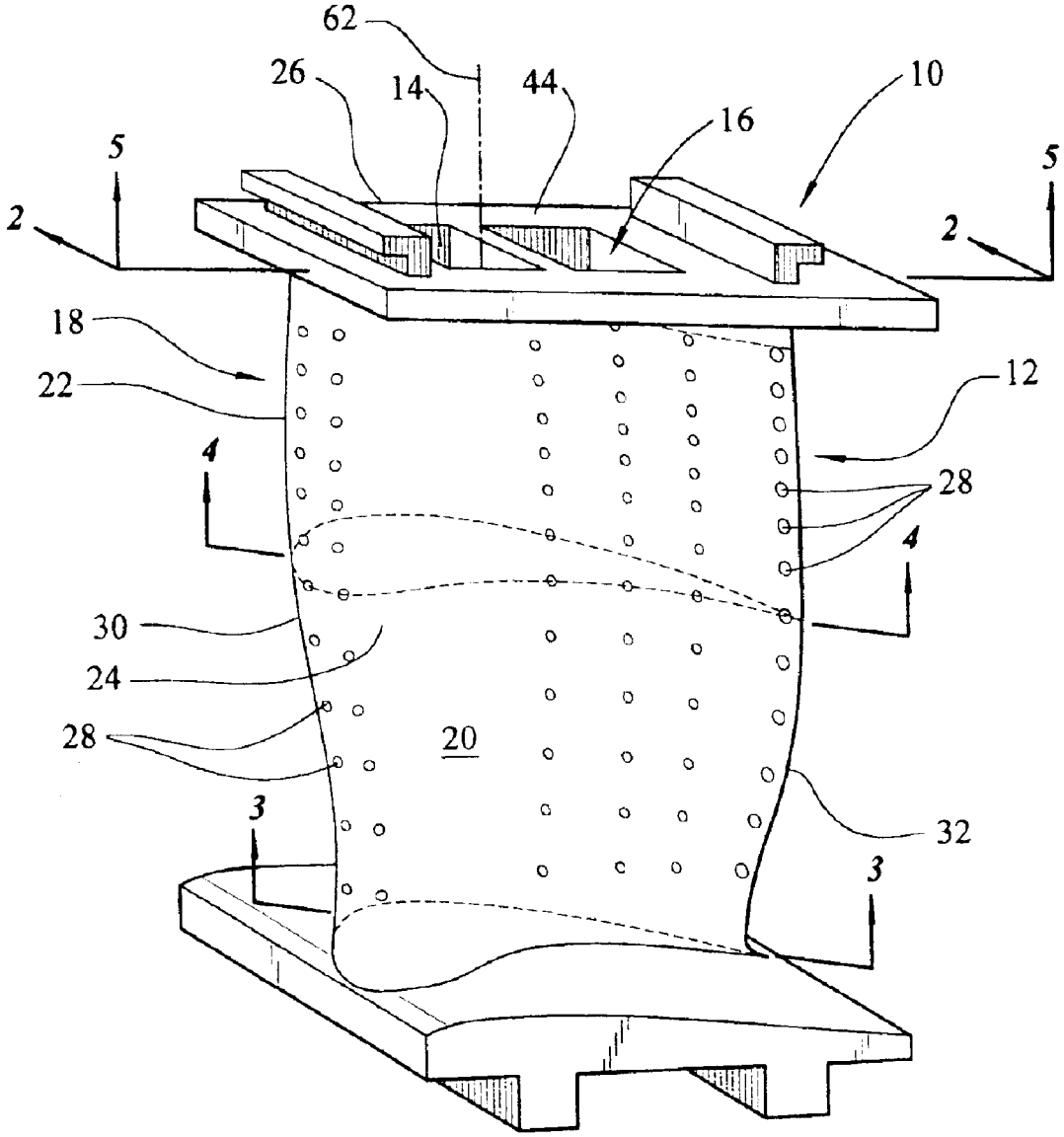
FIG. 1 is a perspective view of a turbine vane having features according to the instant invention.
Figure 2:
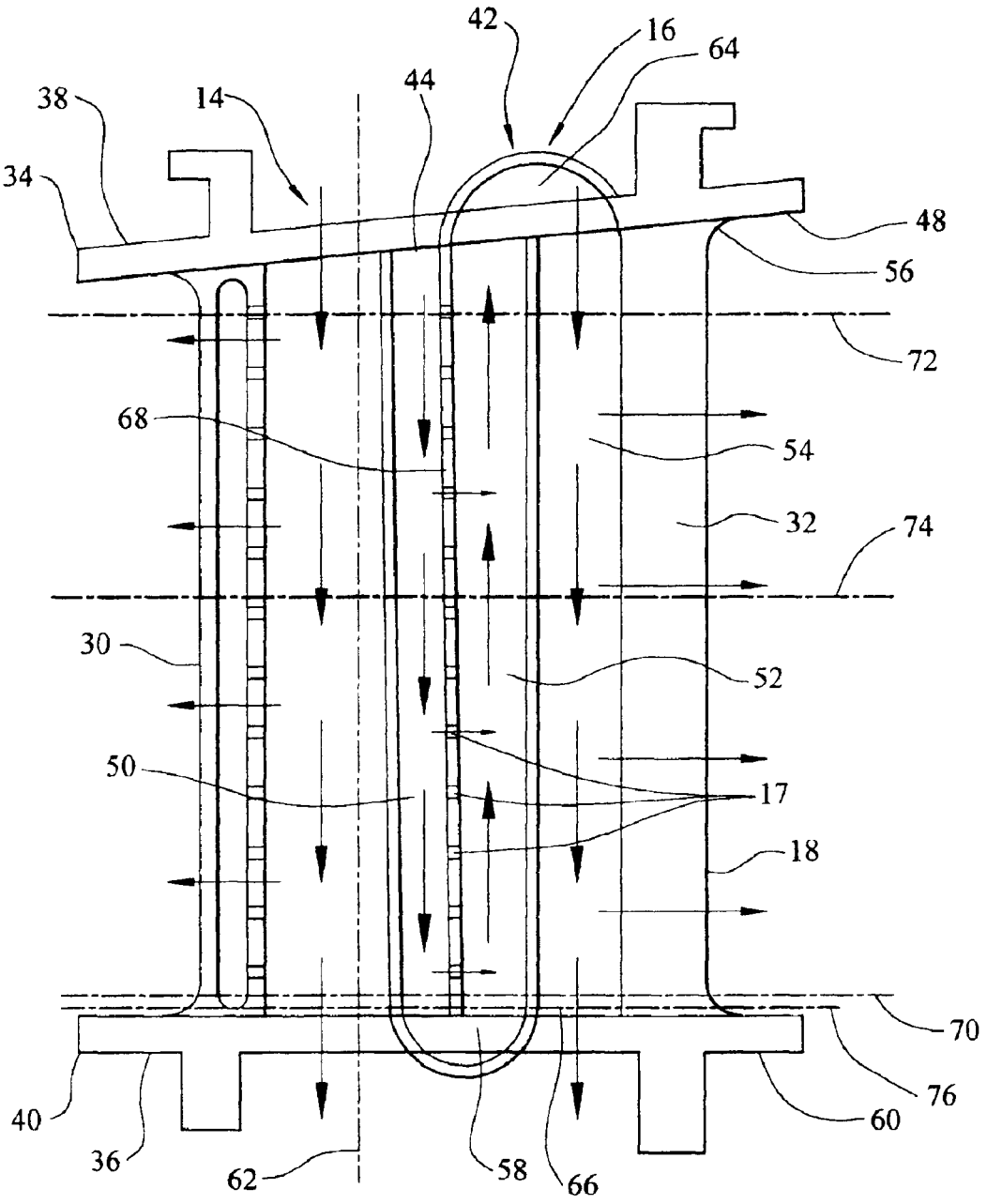
FIG. 2 is cross-sectional view of the turbine vane shown in FIG. 1 taken along line 2—2.
Figure 3:
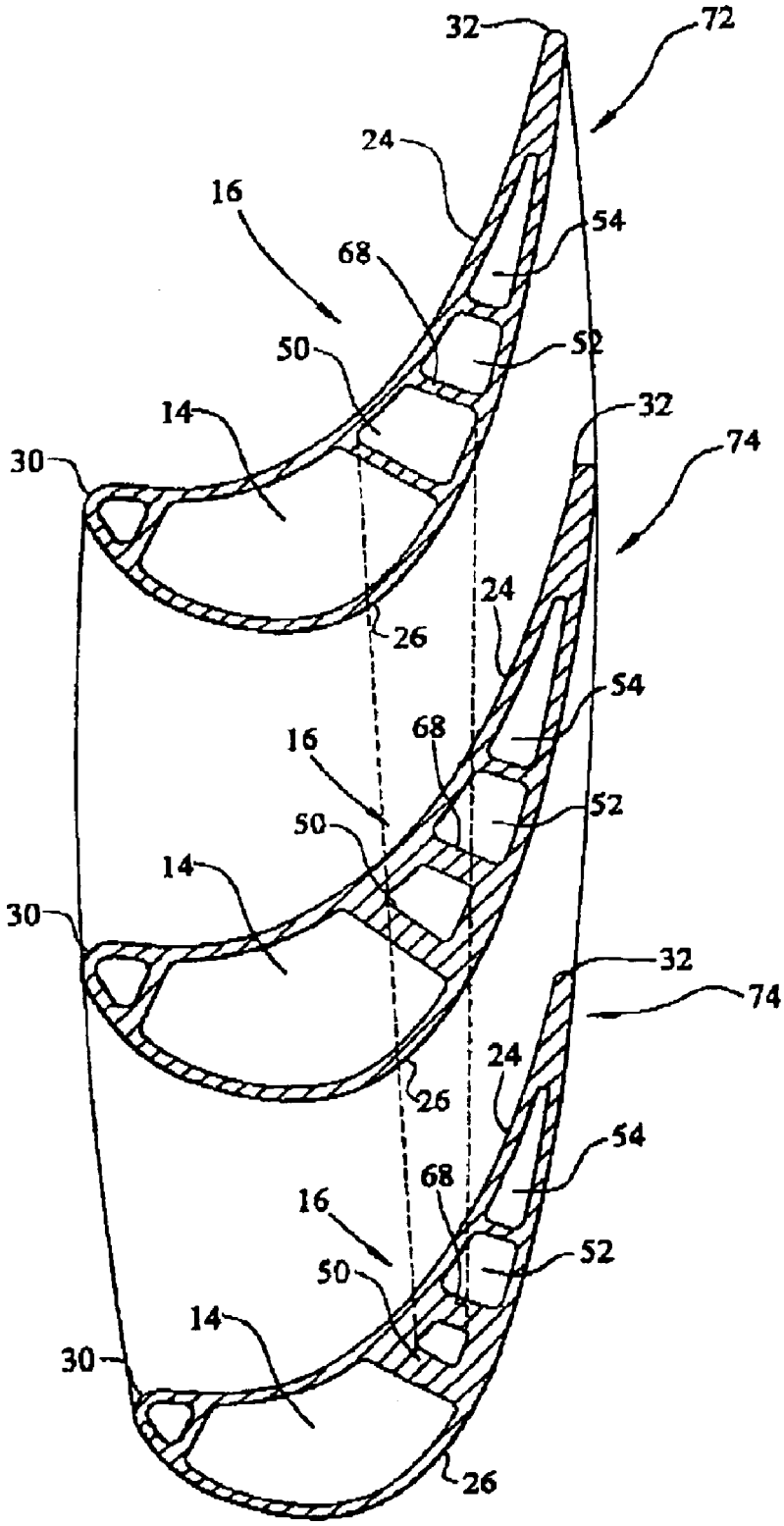
FIG. 3 is a collection of cross-sectional views of the turbine blade shown in FIGS. 1 and 2 with portions taken along line 3—3 at 10 percent span of the serpentine cooling path, along line 4—4 at 50 percent span of the serpentine cooling path, and along line 5—5 at 100 percent span of the serpentine cooling path.

As shown in FIGS. 1–3, this invention is directed to a turbine vane 10 having a cooling system 12 in inner aspects of the turbine vane 10 for use in turbine engines. In particular, the cooling system 10 includes a forward cooling circuit 14 and an aft cooling circuit 16, as shown in FIGS. 1 and 2, for passing cooling fluids, which may be, but is not limit to, air, through the turbine vane 10. The aft cooling circuit 16 may have one or more bypass orifices 17 for short circuiting the aft cooling circuit 16, thereby allowing a greater amount of cooling air to flow through the aft cooling circuit 16.

As shown in FIG. 1, the turbine vane 10 may be formed from a generally elongated vane 18 having an outer surface 20 adapted for use, for example, in a first stage of an axial flow turbine engine. Outer surface 20 may be formed from a housing 22 having a generally concave shaped portion forming pressure side 24 and may have a general convex shaped portion forming suction side 26. The outer surface 20 may have one or more exhaust orifices 28 coupled to the cooling system 12 inside the turbine vane 10. The exhaust orifices 28 may be positioned in the leading edge 30, the trailing edge 32, or in other positions.

As shown in FIG. 2, the forward cooling circuit 14 may have any one of a multitude of configurations. The cooling system 12 is not restricted to a particular configuration of the forward cooling circuit 14. Rather, the forward cooling circuit 14 may be any configuration capable of adequately cooling the forward aspects of the vane 18 and passing air through the vane from an OD at a 100 percent span 34 of the elongated vane 18 to an ID at 0 percent span 36 of the elongated vane 18. A cross-sectional area of the forward cooling circuit 14 at about 100 percent span 34 of the elongated vane 18 may be greater than a cross-sectional area of the forward cooling circuit 14 at about 0 percent span 36 of the elongated vane 18. The 100 percent span 34 of the elongated vane 18 is located at a first end 38 of the vane 18. In at least one embodiment, the first end 38 may be configured to be coupled to a vane carrier (not shown) in a turbine engine. The 0 percent span 36 of the elongated vane 18 is located at a second end 40 of the vane 18. In at least one embodiment, the second end 40 may be configured to be movable coupled to a disc (not shown). The vane 18 may be coupled to the vane carrier so that the vane 18 is held relatively motionless, except for at least vibrations and material expansion and contraction, relative to the rotating disc. The vane 18 may include seals (not shown) at the second end 40 for sealing the vane 18 to the disc.

In at least one embodiment, the aft cooling circuit 16 may include a serpentine cooling path 42, as shown in FIG. 2. The aft cooling circuit 16 may also include one or more cooling cavities for receiving air, directly or indirectly, from an orifice 44 in the first end 38 of the vane 18 and passing the air through the vane 18 to a disc. The aft cooling circuit 16 may also include one or more exhaust orifices 28 in the trailing edge 32 of the vane 18. The serpentine cooling path 42 may include, in part, a first inflow section 50, a first outflow section 52, and a second inflow section 54. The first inflow section 50 may be coupled to the inlet orifice 44 at a first end 38 of the vane 18, which is also the first end 48 of the serpentine cooling path 42 at 100 percent span 56 of the serpentine cooling path 42. The first inflow section 50 may extend toward a first turn 58 at 0 percent span 60 of the serpentine cooling path 42. In at least one embodiment, the first inflow section 50 may be, but is not limited to being, substantially parallel with a longitudinal axis 62 of the vane 18.

The 100 percent span 56 of the serpentine cooling path 42 may be located at 100 percent span 34 of the elongated vane 18. However, the 100 percent span 56 of the serpentine cooling path 42 may be located at other positioning relative to the elongated vane 18. Likewise, while the 0 percent span 60 of the serpentine cooling path 42 may be located at the 0 percent span 36 of the elongated vane 18, as shown in FIG. 2, the 0 percent span 60 of the serpentine cooling path 42 may be located at other positions relative to the elongated vane 18. For instance, the 0 percent span of the serpentine cooling path 42 may be located between about 0 percent span 36 of the elongated vane 18 and about 80 to 90 percent span of the elongated vane 18.

The first outflow section 52 may be in communication with the first inflow section 50 and be coupled to the first turn 58. The first outflow section 52 may extend toward the first end 48 of the serpentine cooling path 42. The first outflow section 52 may or may not extend to the 100 percent span point 56 of the serpentine cooling path 42. In at least one embodiment, the first outflow section 52 may be generally parallel with the first inflow section 50, and in some embodiments, may be generally parallel with the longitudinal axis 62 of the vane 18. The first outflow section 52 may be coupled to a second turn 64. The second inflow section 54 may be coupled to the second turn 64 and may extend toward an exhaust orifice 66 in the vane 18 for exhausting cooling fluids into a disc. The exhaust orifice 66 or surrounding housing may be configured to be movably coupled to a disc (not shown) that is capable of rotating while the vane 18 remains relatively stationary. The second inflow section 54 may include one or more exhaust orifices 28 in the trailing edge 32 of the blade. In other embodiments, the second inflow section 54 may be coupled to one or more exhaust orifices 66 in the vane 18. In at least one embodiment, as shown in FIG. 2, at least a portion of the serpentine cooling path 42 may extend from the 100 percent span 34 of the elongated vane 18 to the 0 percent span 36 of the elongated vane 18.

In at least one embodiment, the first inflow section 50 and the first outflow section 52 are separated by one or more ribs 68. The rib 68 may extend from the 100 percent span 56 of the serpentine cooling path 42 to between about 2 percent span and about 20 percent span of the serpentine cooling path 42. The rib 68 may include one or more bypass orifices 17 extending between the first inflow section 50 and the first outflow section 52. The bypass orifices 17 may be positioned between about 15 percent span 70 of the serpentine cooling path 42 and about 85 percent span 72 of the serpentine cooling path 42. The bypass orifices 17 may be positioned equidistant from each other, positioned in a pattern, or haphazardly positioned on the rib 68, or any combination thereof. The bypass orifices 17 may have different diameters varying between about 2 mm and about 10 mm, or may all have equal diameters.

In at least one embodiment, the fluid dynamics of the cooling system 12 may be improved by adjusting the cross-sectional area of at least the first inflow section 50. In particular, the cross-sectional area of the first inflow section 50 may decrease moving from the 100 percent span 56 of the serpentine cooling path 42 to the 0 percent span 60 of the serpentine cooling path 42. Specifically, a cross-sectional area at the 100 percent span 56 of the serpentine cooling path 42, as shown in FIG. 3, may be larger than a cross-sectional area at the 10 percent span 76 of the serpentine cooling path 42, as shown in FIG. 3. Further, the cross-sectional area at the 100 percent span 56 of the serpentine cooling path 42 may be larger than a cross-sectional area at the 50 percent span 74 of the serpentine cooling path 42 as shown in FIG. 3. For instance, the cross-sectional area of the first inflow section 50 at the 50 percent span 74 of the serpentine cooling path 42 may be about 0.7 units, whereas a cross-sectional area at the 100 percent span 74 of the serpentine cooling path 42 maybe about 1 unit. In addition, the cross-sectional area at the 50 percent span 74 of the serpentine cooling path 42, as shown in FIG. 3, may be larger than a cross-sectional area at the 10 percent span 76 of the serpentine cooling path 42, as shown in FIG. 3. In at least one embodiment, the cross-sectional area of the first inflow section 50 at 10 percent span 76 of the serpentine cooling path 42 may be about 0.4 units, whereas a cross-sectional area at the 100 percent span 74 of the serpentine cooling path 42 may be about 1 unit.

In operation, a cooling fluid, which may be, but is not limited to, air, may enter the vane 18 through the inlet orifice 44 and enter the cooling system 12, as shown in FIGS. 1 and 2. The air not only removes heat from the vane 18 during operation of a turbine engine in which the vane 18 is located, but also supplies air to inner aspects of a disc (not shown). The air supplied to the disc is used, at least in part, to cool turbine blades of the turbine engine. The air entering the inlet orifice 44 passes into the forward and aft cooling circuits 14 and 16. At least some of the air passing into the forward cooling circuit 14 passes through the vane to the disc, and the remainder of the air passes through one or more exhausts orifices 28 in the leading edge 30 of the vane 18. Air passing into the aft cooling circuit 16 enters the first inflow section 50 of the serpentine cooling path 42. At least a portion of the air travels along the length of the first inflow section 50 to the first turn 58, while a portion of the air passes through the bypass orifices 17 in the rib 68. By allowing a portion of the air to pass through the bypass orifice 17 in the rib 68, rather than flowing through the entire length of the first inflow section 50, a larger flow rate of air through the aft cooling circuit 16 is achieved. The increased flow rate results in a greater amount of air being delivered to the disc, which is beneficial for at least some turbine engines. The increased flow may be used for interstage cooling, supplying air to the turbine blade assemblies, and for accounting for leakages between static components and moving components in the turbine engine. In addition, the pressure drop between the inlet orifice 78 and the exhaust orifice 46 is less than serpentine cooling paths not having bypass orifices.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane, comprising:

a generally elongated vane formed from at least one housing and having a leading edge, a trailing edge, a pressure side, a suction side, and a cooling system in the vane;

a serpentine cooling path formed at least from a first inflow section, a first outflow section and a second inflow section, the first inflow section extending from a first end at 100 percent span of the serpentine cooling path to a first turn at 0 percent span of the serpentine cooling path, the first outflow section in communication with the first inflow section and extending from the first turn generally toward the first end of the serpentine cooling path and a second turn, the second inflow section in communication with the first outflow section and extending from the second turn to an opening in a second end of the turbine vane adapted to be movably coupled to a disc; and at least one rib separating by the first inflow section and the first outflow section and extending from the first end of the serpentine cooling path substantially to a second end of the serpentine cooling path; and wherein the at least one rib includes a plurality of bypass orifices positioned between about 85 percent span of the serpentine cooling path and about 15 percent span of the serpentine cooling path for accommodating increased flow of cooling fluids through the turbine vane without negatively impacting turbine vane cooling, and wherein the plurality of bypass orifices create a pathway between the first inflow section and the first outflow section.

2. The turbine vane of claim 1, wherein the plurality of bypass orifices have substantially equal diameters.

3. The turbine vane of claim 2, wherein the diameters of the bypass orifices is between about 2 mm and about 10 mm.

4. The turbine vane of claim 1, wherein the plurality of bypass orifices are evenly spaced relative to each other.

5. The turbine vane of claim 1, wherein the first inflow section has a larger cross-sectional area at 100 percent span of the serpentine cooling path than a cross-sectional area of the first inflow section at 10 percent span of the serpentine cooling path.

6. The turbine vane of claim 1, wherein the first inflow section has a larger cross-sectional area at 100 percent span of the serpentine cooling path than a cross-sectional area of the first inflow section at 50 percent span of the serpentine cooling path.

7. The turbine vane of claim 6, wherein the cross-sectional area of the first inflow section at 50 percent span of the serpentine cooling path is about 0.7 of the cross-sectional area of the first inflow area at 100 percent span of the serpentine cooling path.

8. The turbine vane of claim 1, wherein the first inflow section has a larger cross-sectional area at 50 percent span of the serpentine cooling path than a cross-sectional area of the first inflow section at 10 percent span of the serpentine cooling path.

9. The turbine vane of claim 8, wherein the cross-sectional area of the first inflow section at 0 percent span of the serpentine cooling path is about 0.4 of the cross-sectional area of the first inflow area at 100 percent span of the serpentine cooling path.

10. The turbine vane of claim 1, further comprising a forward cooling circuit extending from about 100 percent span of the elongated vane to about 0 percent span of the elongated vane and having a plurality of exhaust orifices in the leading edge of the elongated vane.

11. The turbine vane of claim 10, wherein a cross-sectional area of the forward cooling circuit at about 100 percent span of the elongated vane is greater than a cross-sectional area of the forward cooling circuit at about 0 percent span of the elongated vane.

12. The turbine vane of claim 1, wherein the first turn of the serpentine cooling path is located at about 0 percent span of the elongated vane.

13. The turbine vane of claim 1, wherein the second turn of the serpentine cooling path is located at about 100 percent span of the elongated vane.

14. A turbine vane, comprising:

a generally elongated vane formed from at least one housing and having a leading edge, a trailing edge, a pressure side, a suction side, and a cooling system;

a serpentine cooling path formed at least from a first inflow section, a first outflow section and a second inflow section, the first inflow section extending from an opening at a first end of the turbine vane adapted to be coupled to a vane carrier and a first end at 100 percent span of the serpentine cooling path to a first turn at 0 percent span of the serpentine cooling path, the first outflow section in communication with the first inflow section and extending from the first turn generally toward the first end of the serpentine cooling path and a second turn, the second inflow section in communication with the first outflow section and extending from the second turn to an opening in a second end of the turbine vane adapted to be movably coupled to a disc;

wherein the first inflow section and the first outflow section are separated by at least one rib extending from the first end of the serpentine cooling path substantially to a second end of the serpentine cooling path, wherein than at least one rib includes a plurality of bypass orifices positioned between about 85 percent span of the serpentine cooling path and about 15 percent span of the serpentine cooling path creating a pathway between the first inflow section and the first outflow section; and wherein the first inflow section has a larger cross-sectional area at 100 percent span than a cross-sectional area of the first inflow section at 10 percent span.

15. The turbine vane of claim 14, wherein the first inflow section has a larger cross-sectional area at 100 percent span of the serpentine cooling path than a cross-sectional area of the first inflow section at 50 percent span of the serpentine cooling path.

16. The turbine vane of claim 15, wherein the cross-sectional area of the first inflow section at 50 percent span of the serpentine cooling path is about 0.7 of the cross-sectional area of the first inflow area at 100 percent span of the serpentine cooling path.

17. The turbine vane of claim 14, wherein the first inflow section has a larger cross-sectional area at 50 percent span of the serpentine cooling path than a cross-sectional area of the first inflow section at 0 percent span of the serpentine cooling path.

18. The turbine vane of claim 17, wherein the cross-sectional area of the first inflow section at 0 percent span of the serpentine cooling path is about 0.4 of the cross-sectional area of the first inflow area at 100 percent span of the serpentine cooling path.

* * * * *